US005938339A

United States Patent [19]

Ouchi

[11] Patent Number: 5,938,339

[45] Date of Patent: Aug. 17, 1999

[54] GORED PACKING BAG PROVIDED WITH AN OPENING AND CLOSING FASTENER AND METHOD FOR PRODUCING SAME

[76] Inventor: Toshikatu Ouchi, 42-10, Higashi Nippori 2-chome, Arakawa-ku, Tokyo, Japan

[21] Appl. No.: 08/775,879

[22] Filed: Jan. 2, 1997

[51] Int. Cl.[6] ..... B65D 30/20; B65D 33/16

[52] U.S. Cl. ..... 383/63; 383/120

[58] Field of Search ..... 383/63, 65, 120

[56] References Cited

U.S. PATENT DOCUMENTS

| | | | |
|---|---|---|---|
| 3,827,472 | 8/1974 | Uramoto | 383/63 |
| 4,332,344 | 6/1982 | Strodthoff | 383/63 |
| 4,971,454 | 11/1990 | Branson et al. | 383/63 |
| 5,004,356 | 4/1991 | Matsui | 383/63 |
| 5,059,036 | 10/1991 | Richison et al. | 383/63 |
| 5,275,491 | 1/1994 | Kuge et al. | 383/120 |
| 5,364,189 | 11/1994 | Kuge et al. | 383/63 |

FOREIGN PATENT DOCUMENTS

| | | | |
|---|---|---|---|
| 1545797 | 11/1968 | France | 383/120 |
| 5147663 | 6/1993 | Japan | 383/63 |

*Primary Examiner*—Stephen P. Garbe
*Attorney, Agent, or Firm*—Armstrong, Westerman, Hattori, McLeland & Naughton

[57] ABSTRACT

A gored packing bag comprises a front body 1, a rear body 2, gores 3,4 formed by gluing the front body and the rear body, and a pair of fasteners 5, 6 arranged between the front body, the rear body, and the gores, one of the fasteners being glued along its whole length on an inner surface of the front body close to an open end thereof, while both end portions of the other fastener 8 being glued to a half side 28,29 of each of the gores facing the front body and an intermediate remainder of the fastener tape 8 in the width direction being glued on an inner surface of the rear body, and a half side 30, 31 of each of the gores in the width direction being glued on an inner surface of the rear body.

4 Claims, 9 Drawing Sheets

GORED PACKING BAG PROVIDED WITH AN OPENING AND CLOSING FASTENER AND METHOD FOR PRODUCING SAME

BACKGROUND OF THE INVENTION

This invention relates to a gored packing bag provided with an opening and closing fastener on an opened portion thereof. When a batch of contents such as powdered beverages, e.g., cocoa are taken out from a packing bag, an opened portion thereof is repeatedly opened and closed and should desirably be provided with an opening and closing fastener. Conventionally known is a flat vinyl packing bag without gores or bellows which is provided with an intermeshing fastener on both inner surfaces of face and back bodies so as to freely open and close an opened portion thereof. There has also been proposed a gored packing bag which can keep a larger amount of contents. In such a gored packing bag, however, a fastener is hardly attached or, even if it is attached, a free play of gores is suppressed around the fastener. As the fastener can be attached only between inner ends of gores, length of the opened portion is decreased when the width of gores is increased to keep a larger amount of contents and vice versa, the longer the opened portion, the shorter the gores become and the lesser an effect of gores is exhibited.

As to a method for producing the above mentioned packing bag, as shown in FIG. 9, a bag body and a fastener portion are independently manufactured and then integrated. This increases unfavorably not only numbers of parts but production steps of the bag and reduces productivity thereof, thereby increasing the production cost as a whole.

SUMMARY OF THE INVENTION

It is an object of the present invention to provide a gored packing bag which comprises a front body, a rear body, gores formed by gluing at least three sides thereof between both two sides and one end portion of the front body and the rear body into a combined situation, and a pair of opening and closing fastener in arranged between the front and rear body or the gores, one of a base tape being glued as a whole length on an inner surface of the front or rear body close to an open end thereof, while both end portions of the other base tape being glued to a half side of gore facing to the front or rear body and an intermediate remainder of the base tape in the width direction being glued on a corresponding inner surface of the rear or front body, and a fixed portion of remaindered gores in the width direction being glued on a corresponding inner surface of the rear or front body.

The gores may be formed either fully from the bottom end to the open end of the packing bag, or only partially from the bottom end to a line of the fastener along both sides. In either case, four sides of the bag will be sealed after the contents are charged. The contents may be charged from an unsealed portion of the bag in a half-completed situation in which either the bottom or open portion is unsealed, followed by sealing of the unsealed portion.

A laminated sheet of resin films having different fusion temperatures is used as the front body and the rear body. Continuous production of the bag can be conducted conveniently when a resin film of lower fusion temperature is used inside.

Further object of the present invention is to provide a method for continuously producing a gored packing bag which comprises:

a step for setting a gore sheet, which is double folded so that both sides in the width direction are faced each other along the center line on an upper side thereof while keeping a resin film of lower fusion temperature outside of a belt-like thermoplastic resin sheet prepared by laminating two kinds of resin films having different fusion temperatures, and one of a pair of fastener tapes in thus described order to a side of a belt-like thermoplastic resin sheet prepared by laminating two kinds of resin films having different fusion temperatures, followed by welding these three parts in fixed width along the fastener tape;

a step for setting the other one of a pair of fastener tapes to a side of the belt-like thermoplastic resin sheet prepared by laminating two kinds of resin films having different fusion temperatures so that the belt-like sheet and one of the fastener tapes are arranged in the manner of mirror image, followed by welding these two parts in fixed width along the fastener tape, this step being conducted simultaneously with the above mentioned step;

a step for folding a semi-fabricated product produced by the above mentioned steps so that each pair of fastener tapes is faced each other and welded portions thereof are put one upon another, followed by thermally welding a center portion of adjacent two gore sheets and one of a side edge of belt-like sheets between center portions of these two gore sheets; and a step for cutting along the center line of thus thermally welded gore sheets in the width direction of the said sheet.

In the present packing bag, as one side of the gores where the fastener is glued functions as the gore, so that a larger amount of contents can be charged and taken out easily. Further, continuous production of reduced steps can be conducted when suitable resin material is used.

DETAILED DESCRIPTION OF THE PREFERRED EMBODIMENTS

Although preferred embodiments of the present invention will be described referring to the attached drawings, it should be understood that the present invention is not restricted by these embodiments.

A gored packing bag according to a first embodiment of the present invention is shown in FIGS. 1 to 5. Numeral 1 in these figures designates a rectangular front body. Numeral 2 designates a rear body of the same shape as the front body. Numerals 3 and 4 designate gores arranged between both side portions of the front body 1 and the rear body 2, respectively. Numerals 5 and 6 designate a fastener in pair which consists of a groove and a protrusion and are fixable to each other. Numerals 7 and 8 designate base tapes of the fastener 5 and 6. In the packing bag of this embodiment, the gores are formed in extent starting from the bottom portion of the bag and ending at a line defined at the fastener, while each part of the packing bag is made of thermoplastic resins.

The front body 1, the rear body 2 and the gores 3 and 4 are made of a laminated sheet prepared by laminating a resin film of a lower fusion temperature on one surface of a substrate sheet.

The gores 3 and 4 are each folded to form a double layer in the width direction and arranged between both side portions of the front body 1 and the rear body 2 so that each fold of each gore is kept inside. Both side portions of each of the gores are glued to the side portions of the front body 1 and the rear body 2. Numeral 9 designates a glued portion.

Figure 1:
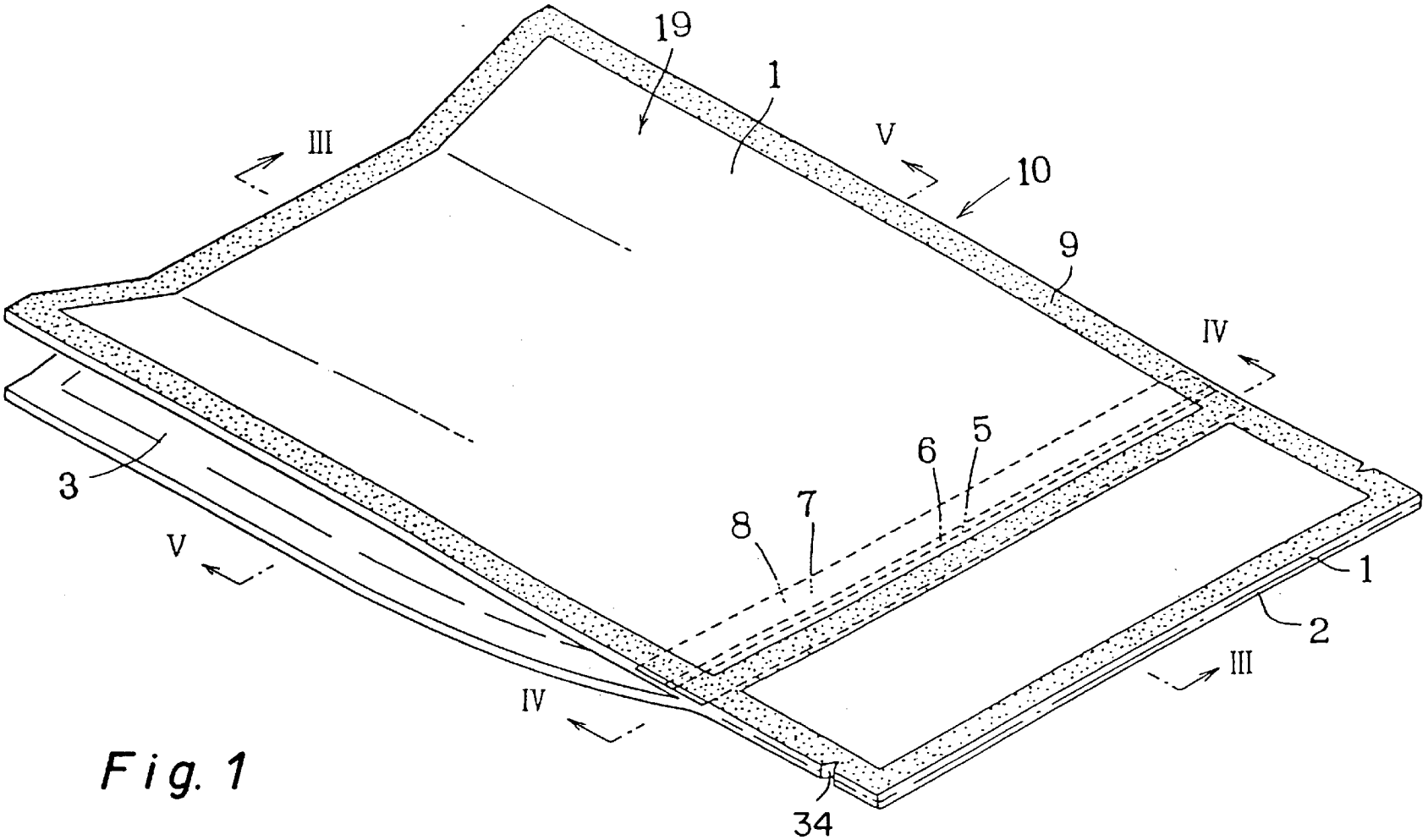
FIG. 1 is a perspective view of a packing bag of the present invention.
Figure 2:
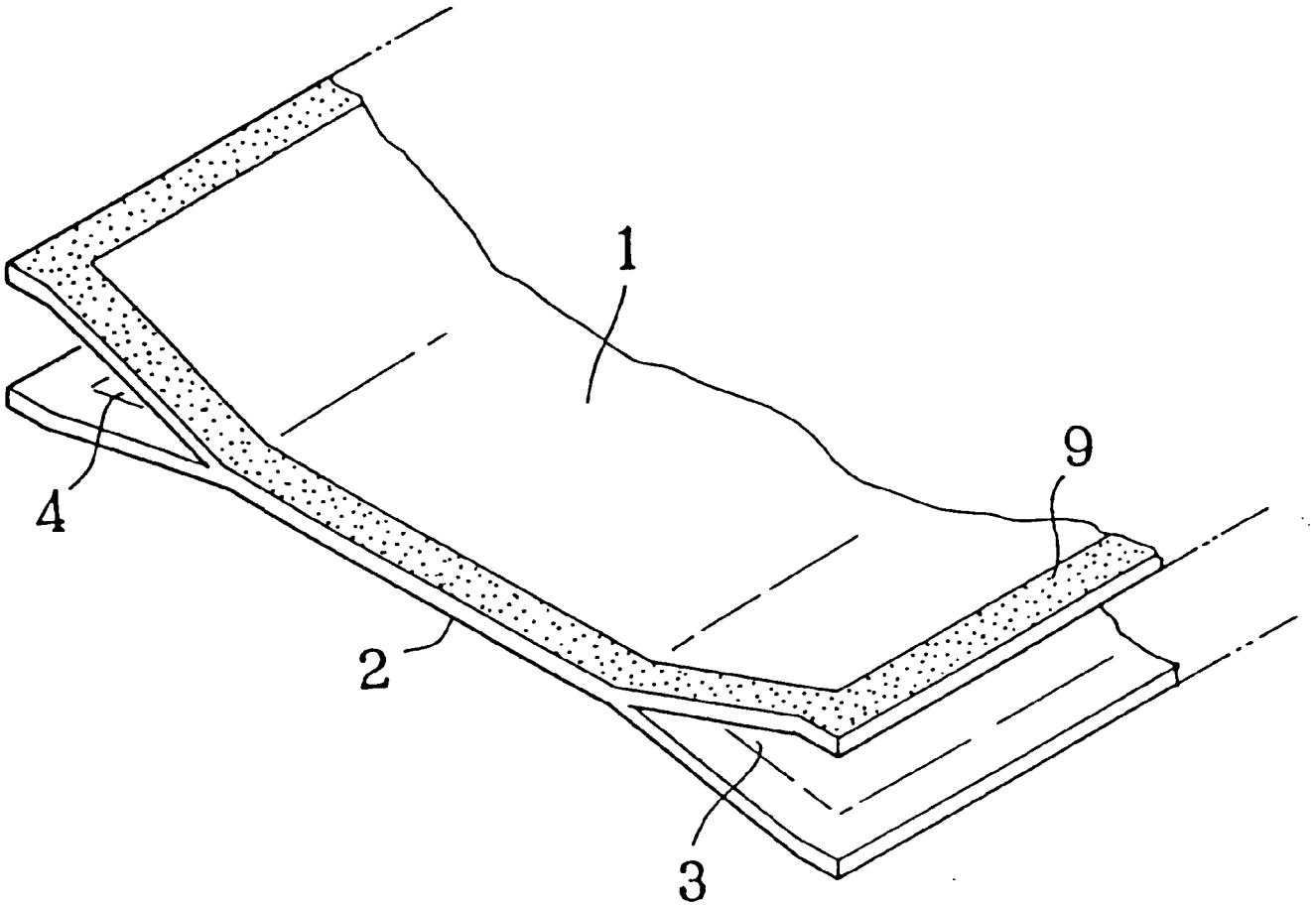
FIG. 2 is a partially perspective view of a bottom portion of a packing bag shown in FIG. 1 and FIG. 6.

As described above, the front body 1 and the rear body 2 are glued to the gores 3 and 4 along each side portion, while bottom portions of these bodies are partially glued to each other in an intermediate region thereof and both end portions of the front and rear bodies are glued to each half side of the double layered gores 3 and 4 as shown in FIG. 2.

Figure 3:
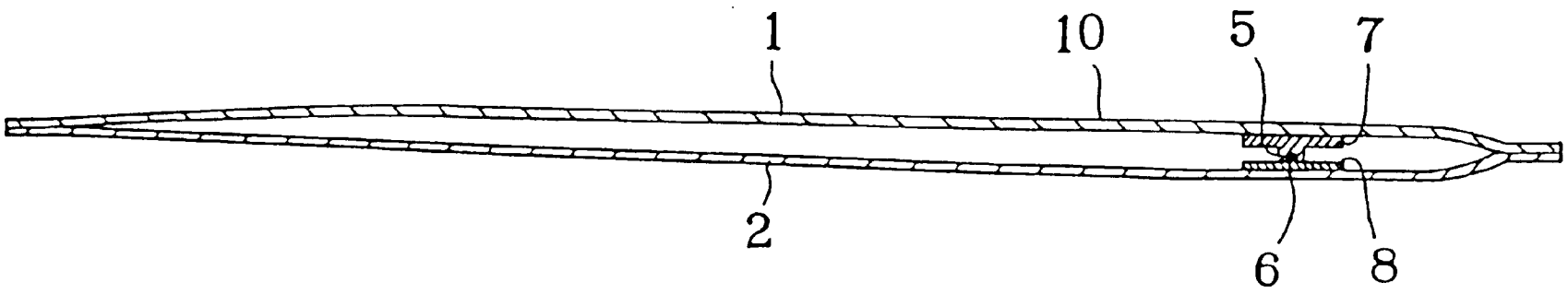
FIG. 3 is a sectional view taken on line III—III in FIG. 1.
Figure 4:
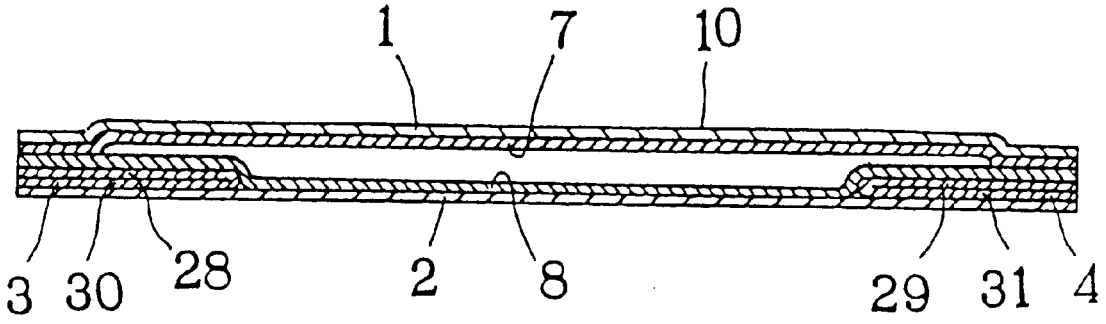
FIG. 4 is a sectional view taken on line IV—IV in FIG. 1.
Figure 5:
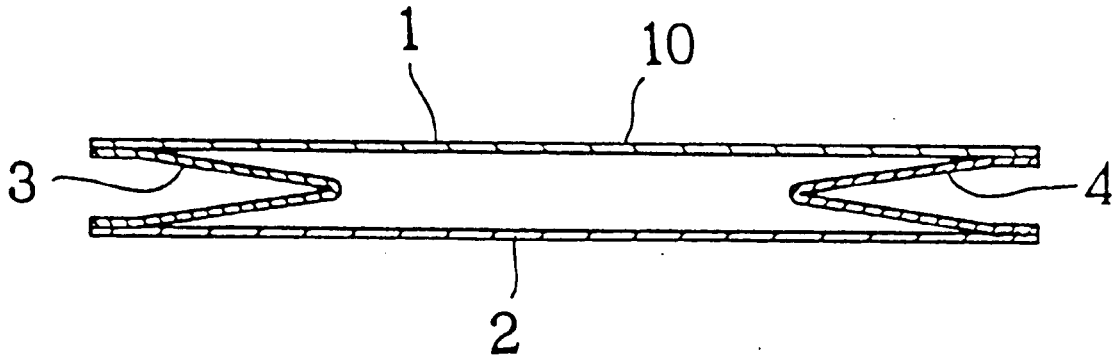
FIG. 5 is a sectional view taken on line V—V in FIG. 1.

A pair of mutually fixable fasteners 5 and 6 are arranged to a location close to an open end on the inner surface of a bag body 10 as shown in FIG. 3. That is, the base tape 7 of one of the fastener 5 is glued along its whole length across the front body 1 on an inner surface thereof as shown in FIG. 4. On the other hand, both end portions of the base tape 8 of the other one of the fasteners 6 are glued on half side surfaces 28 and 29 of the gores 3 and 4 facing to the front body 1, and a remainder intermediate portion thereof is glued on the inner surface of the rear body 2, as similarly shown in FIG. 4. Both end portions of the rear body 2 outside of the glued intermediate portion thereof are glued to each half side surfaces 30 and 31 of the gores 3 and 4 facing to the rear body 2.

The front body 1 and the rear body 2 are thermally fused along peripheries thereof in a region close to the open end from the fastener to yield a sealed condition, while a notch 34 is formed on both side ends for easy tearing.

Figure 6:
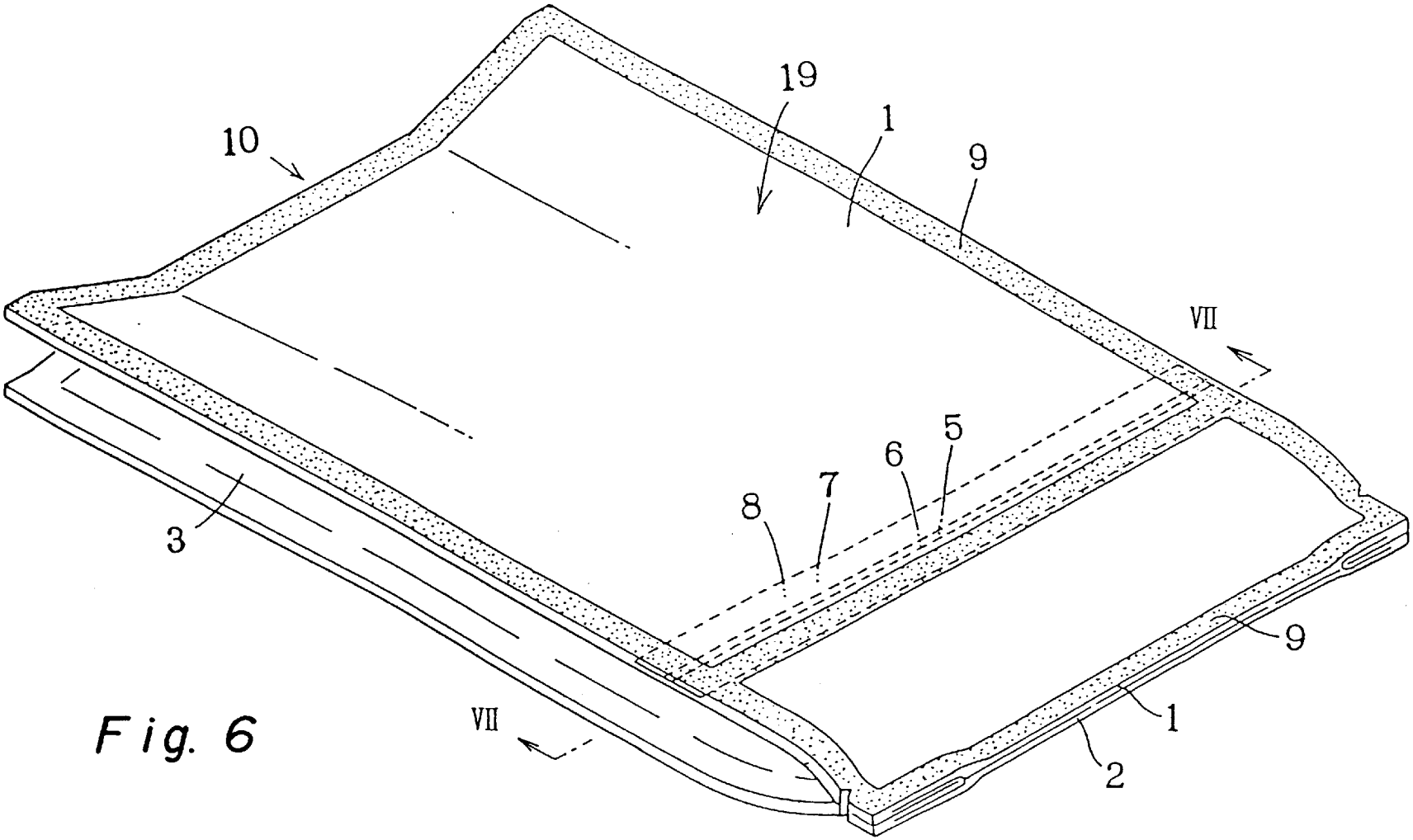
FIG. 6 is a perspective view of a packing bag of another embodiment of the present invention.
Figure 7:
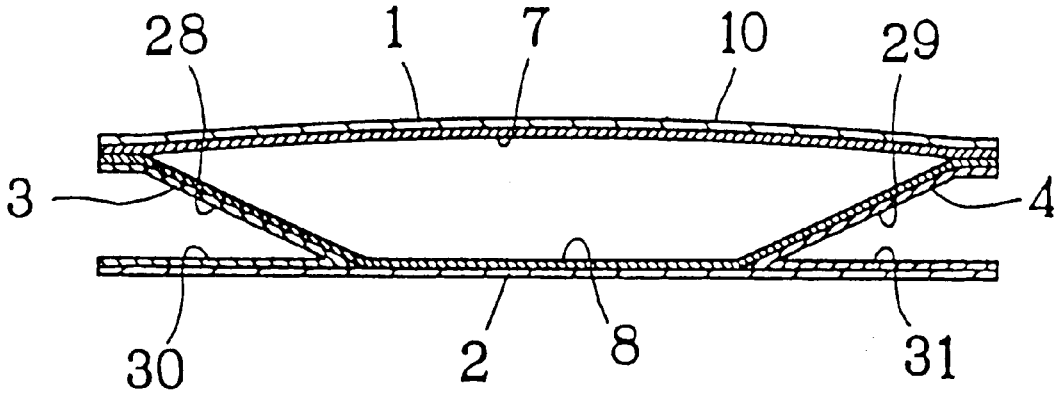
FIG. 7 is a sectional view taken on line VII—VII in FIG. 6.

In FIGS. 6 and 7, a packing bag according to a second embodiment of the present invention is shown. This packing bag is similar to that of described in the first embodiment except that gores 3 and 4 extend from the bottom end of the bag up to an open end thereof across a pair of fasteners and, as shown in FIG. 7, extended gores 3 and 4 gives the fastener more flexibility than the first embodiment.

Figure 8:
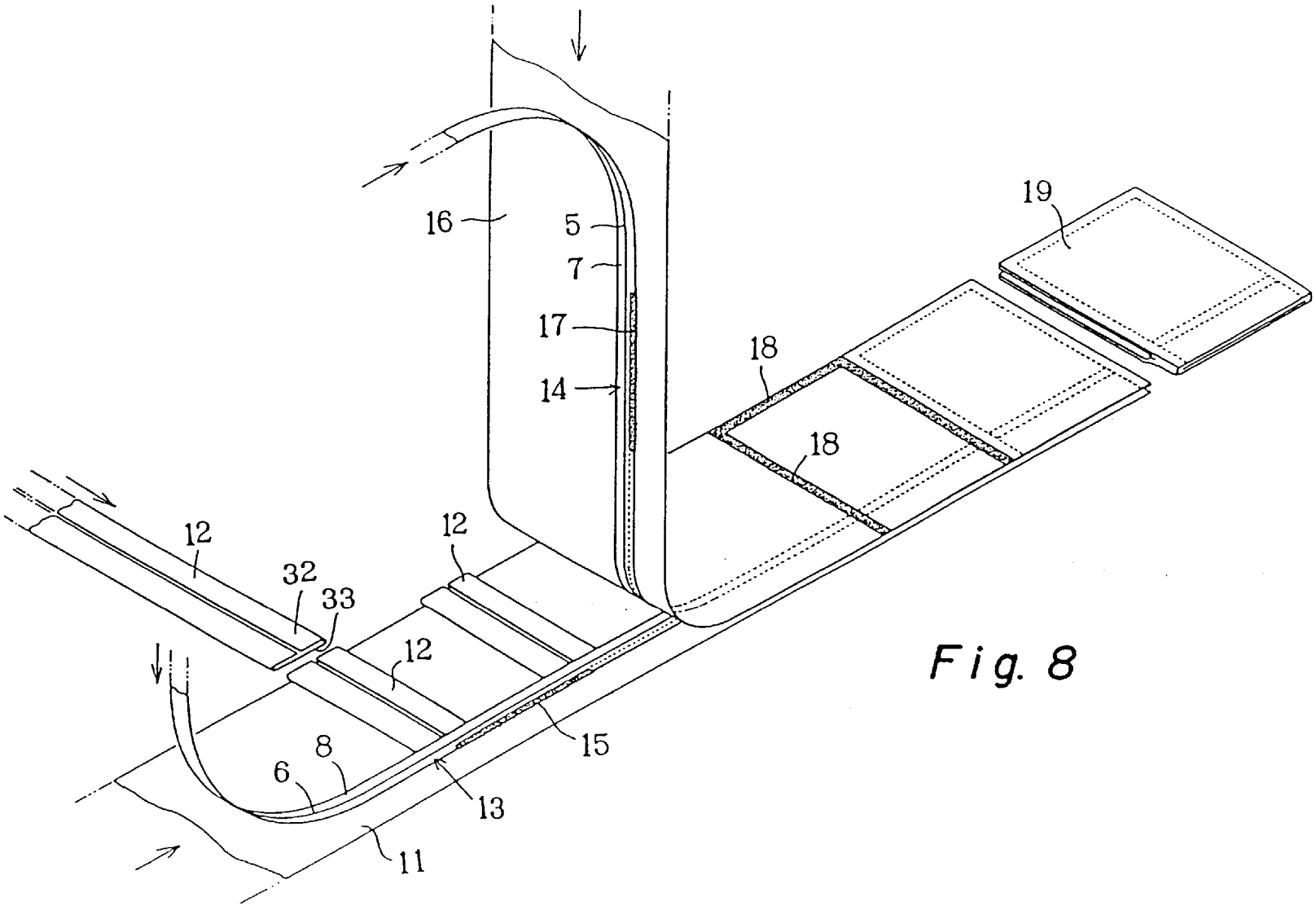
FIG. 8 shows an example of a production process of a packing bag shown in FIG. 1.
Figure 9:
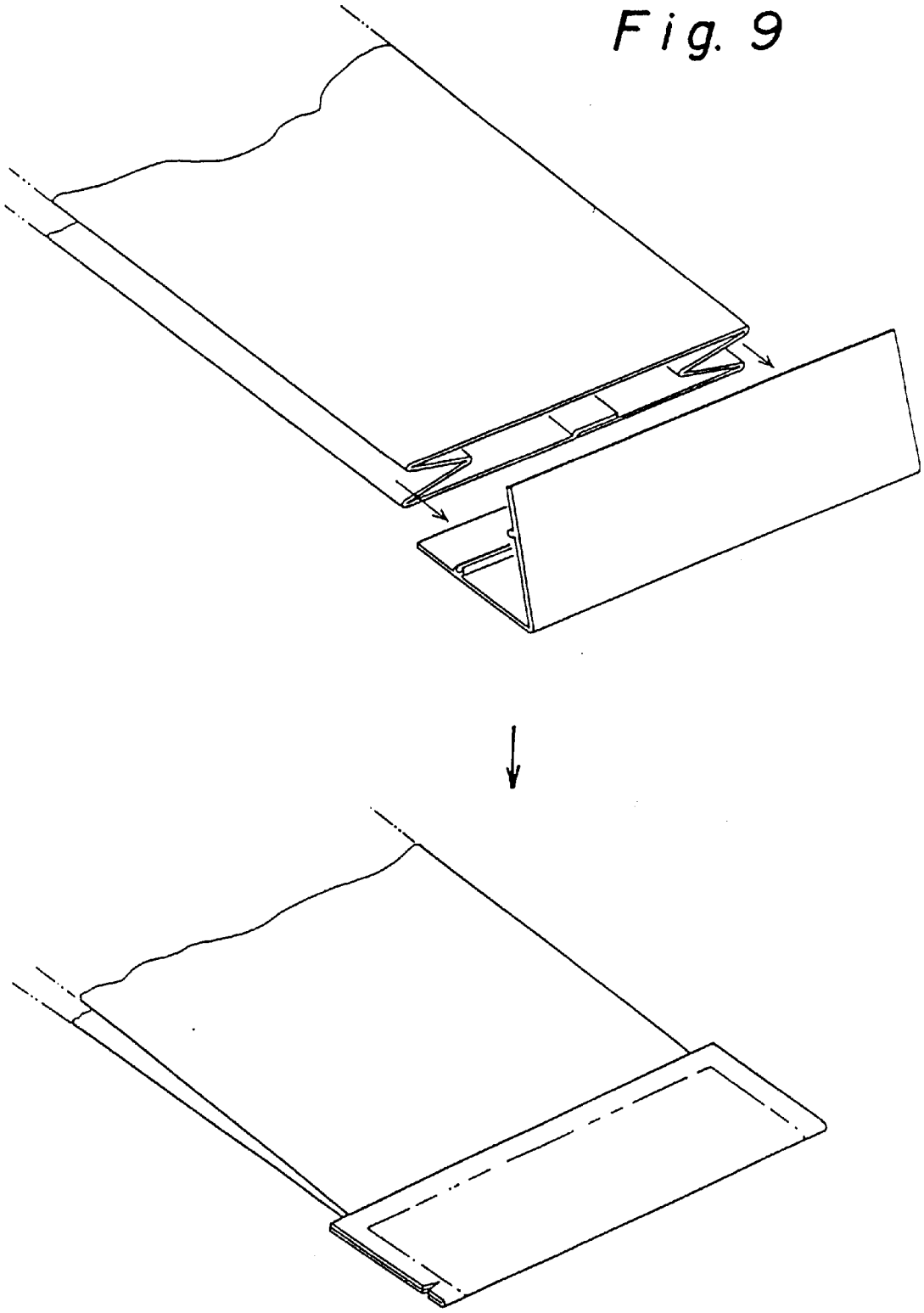
FIG. 9 shows a production process of a conventional gored packing bag.

Referring now to FIG. 8, a method for producing a packing bag of the first embodiment of the present invention.

A belt-like and thermoplastic resin sheet 11 used for the rear body is set on a fixed position. The rear body sheet 11 is a laminate of two kinds of resin films having different fusion temperatures, in which a resin film of lower fusion temperature is laminated on the upper side.

A thermoplastic resin sheet 12 used for the gores is double folded to form a double layer so that both ends in the width direction face each other on the center line of the upper side, and is fed crosswise to the rear body sheet 11 to set thereon. A tip end of the gore sheet should not crossover a line where fastener tapes are to be set. The gore sheet 12 in a double folded situation is also a laminate of two kinds of resin films having different fusion temperatures, a film of lower fusion temperature being set outside.

Then, one of the fastener tapes 13 and 14 in couple, which is made of a thermoplastic resin and consisted of integrally formed fasteners 5 and 6 on the base tape 7 and 8, is set on the rear body sheet 11 as well as the tip end of the gore sheet 12. The fastener tape 13 is set on a location close to an end in the width direction of the rear body sheet 11. Further, the fastener tape 13 is set on a site close to the tip end of the gore sheet 12 while keeping the sheet 12 not to crossover the tape 13.

The fastener tape 13 is then thermally welded to the rear body sheet 11 and the gore sheet 12 at a fusion temperature of a laminated resin film which is fused at a slightly lower temperature. Numeral 15 designates a welded portion. In the double layered gore sheet 12, only an outside surface of each layer of the gore sheet 12 is welded, that is, the upper side portion 32 being welded to the fastener tape 13 and the lower portion 33 being welded to the rear body sheet 11, while the inner surfaces of the double layered gore sheet 12 are not welded to keep a separated situation.

The gore sheet 12 thus welded is then cut into a size in length approximately same as the width of the rear body sheet 11.

After these steps have been conducted, the rear body sheet 11, the fastener tape 13 and the gore sheet 12 are sent ahead at the bag-width intervals in an integrally welded situation.

On the other hand, except the gore sheet 12, a belt-like front body sheet 16 prepared by laminating two kinds of resin films having different fusion temperatures and the other one of a pair of fastener tape 14 are set so that the above mentioned rear body sheet 11 and the fastener tape 13 are arranged in the manner of a mirror image, and are welded in the width similar to the welded width of the rear body sheet 11 and the fastener tape 13. Numeral 17 designates a welded portion. The rear body sheet 11 and the fastener tape 13 are sent ahead after they are welded.

The rear body sheet 11 and the front body sheet 16 are superimposed so that each fastener is faced each other and welded portions thereof are put one upon another, and in such a situation, three peripheral portions comprising both side edges and either the bottom edge or the open edge are thermally welded. Numeral 18 designates a portion thus welded. The center line of the welded portion of gore sheet 12 is then cut off in the width direction one by one.

As has been described above, gored packing bags of the present invention can be produced continuously and automatically.

One of the four sides of the present packing bag is kept in an unsealed situation, which is used to insert the contents. The contents may be inserted in the packing bag either before or after a cutting process.

What is claimed is:

1. A gored packing bag, comprising:

a front body;

a rear body;

gores, said bag being formed by gluing two sides and one end portion of the front body and the rear body; and a pair of opening and closing fasteners arranged between the front body, the rear body and the gores, one of said fasteners being glued along a whole length thereof on an inner surface of the front body close to an open end thereof, while both end portions of another one of the fasteners being glued to a half side of each one of said gores facing the front body and an intermediate portion of the another one of the fasteners in the width direction being glued on an inner surface of the rear body, and another half side of each of said gores in the width direction being glued on an inner surface of the rear body.

2. A gored packing bag claimed in claim 1 wherein the gores are formed from the one end portion to a line defined by the fasteners of the packing bag, no gore being formed beyond the line defined by the fasteners.

3. A gored packing bag claimed in claim 1 wherein the gores are formed from the one end portion to an open end of the packing bag, across the fasteners.

4. A gored packing bag claimed in claim 1, wherein the front body and the rear body comprise laminates of resin films having different fusion temperatures, a resin film of lower fusion temperature being laminated inside thereof.

* * * * *